United States Patent [19]

LaBounty

[11] Patent Number: 4,697,509

[45] Date of Patent: Oct. 6, 1987

[54] AUTO BODY CRUSHING DEVICE

[76] Inventor: Roy E. LaBounty, 1607 Eighth Ave., Two Harbors, Minn. 55616

[21] Appl. No.: 848,770

[22] Filed: Apr. 7, 1986

[51] Int. Cl.[4] ..... B30B 9/32

[52] U.S. Cl. ..... 100/233; 100/100; 100/901; 294/88; 30/134; 414/732

[58] Field of Search ..... 100/901, 100, 233, 295; 414/732; 30/134; 294/88

[56] References Cited

U.S. PATENT DOCUMENTS

| | | | |
|---|---|---|---|
| 3,802,731 | 4/1974 | LaBounty | 294/88 |
| 4,017,114 | 4/1977 | LaBounty | 294/88 |
| 4,104,792 | 8/1978 | LaBounty | 30/134 X |
| 4,441,415 | 4/1984 | Hawkins | 100/901 X |
| 4,442,766 | 4/1984 | Hawkins | 100/901 X |
| 4,519,135 | 5/1985 | LaBounty | 30/134 X |

OTHER PUBLICATIONS

Blueprint (one page) dated 8/4/79 entitled "Hugger" Equipment Clamp, Blueprint Drafted by Mark D. Rafn, LaBounty Manufacturing, Inc., Two Harbors, MN 55616.

*Primary Examiner*—Peter Feldman

*Attorney, Agent, or Firm*—Palmatier & Sjoquist

[57] ABSTRACT

A portable crusher for removeable attachment to the boom structure and hydraulic system of a mobile power source such as a backhoe, or front end loader-type machine for compacting scrap metal and in particular automobile bodies. The crusher includes a frame having a large panel-shaped fixed jaw, integral with and depending from one end of the frame. The portable crusher also includes a panel-shaped operable jaw adjacent the frame and depending therefrom. The operable jaw is connected to the frame by two pairs of links so that the operable jaw can be swung towards and away from the fixed jaw, and so that during such movement the operable jaw is maintained in a substantially parallel relationship with the fixed jaw. The crusher includes a hydraulic cylinder secured on one end to a pair of the links and on its other end to the frame for operating the operable jaw.

19 Claims, 3 Drawing Figures

AUTO BODY CRUSHING DEVICE

BACKGROUND OF THE INVENTION

1. Field of the Invention

The present invention relates to attachments for the boom structure and hydraulic system of a mobile power source such as a hydraulic excavator, tractor, or the like, and in particular to such attachment that are used for handling metal scrap.

2. Background

Metal scrap, and in particular, automobile bodies, represent an important recyclable resource of various metals. However, the scrap metal industry traditionally operates on very slim margins, and thus, to profitably handle such materials they must be processed as quickly and efficiently as possible.

Junked automobiles present a particular problem, primarily due to their size, which prevents their efficient transport to central processing plants that shred or melt such scrap. Thus, various equipment has been designed to compress or compact automobiles to a smaller size to facilitate their shipment in greater numbers on a given truck or rail car.

Such compressing equipment generally consists of large, stationary presses. Such presses generally operate hydraulically to either compact the automobile in both a longitudinal and vertical direction thereby forming a bale, or by simply flattening in only a vertical direction. In either case, the automobile is reduced substantially in volume, and thus, can be more cost effectively transported.

However, such presses are generally very expensive and are of limited use as they are dedicated primarily to the single purpose of compacting automobiles. Thus, smaller scrap dealer cannot justify the expense of such a machine, and therefore must continue to transport automobile bodies to yards having such equipment or to processing stations, in their uneconomical full size form.

SUMMARY OF THE INVENTION

An object of the present invention is to provide a device that can efficiently and inexpensively crush metal scrap, and in particular, automobile bodies.

Another object of the present invention is to provide such a metal scrap compressing device that is portable through attachment to the boom structure and hydraulic system of a mobile power source such a hydraulic excavator, backhoe or a tractor having a front end loader.

A feature of the present invention is a pair of large panel shaped jaws wherein one of the jaws is substantially stationary or fixed and the other jaw is movable with respect thereto. The fixed jaw is integrally secured to an elongate and generally horizontally extending frame which attaches to the boom structure and hydraulic system of such a mobile power source to be supported and manipulated thereby. In its operative position and fixed jaw is located at one end of the frame and depends therefrom. The operable jaw is suspended beneath the frame in confronting relation to the fixed jaw and is connected by linkage arms to a middle portion of the frame so that it can be moved towards and away from the fixed jaw, and during such movement maintained in a substantially parallel relationship with the fixed jaw. A hydraulic cylinder is used to operate the movable jaw and is pivotally connected on one end to the linkage arms and pivtoally connected on its other end to the frame.

Another feature of the present invention is an adjustable securing member or boom extension pivotally connected on one end to the middle portion of the frame, and on its other end pivotally connected to the boom structure and hydraulic system of the excavating machine. Thus, the securing member provides for attachment of the frame to the boom structure and hydraulic system of the excavating machine, and in particular, is designed to allow the jaws to be positioned and operated in a vertical orientation with respect to the ground. In addition, the adjustment member includes a hydraulic cylinder, one end of which is pivotally secured to the adjustable securing member and the opposite end thereof pivotally secured to the middle portion of the frame.

The operation of the jaws of the present invention can be appreciated wherein the hydraulic cylinder connected to the parallelogram linkage is used to move the operable jaw towards and away from the fixed jaw. The parallelogram linkage maintains the jaws in a substantially parallel orientation; thus, the jaws are designed to evenly compress any scrap material therebetween.

Specifically, as to the crushing of automobile bodies, it is preferable that the wheels be removed and that the body be first tipped upon its side. In this manner, as the jaws can be positioned so thay they depend vertically from the frame to the ground, the jaws can be opened and then placed down over or swung onto the automobile body with the jaws confronting the roof and running gear of the body. Operation of the hydraulic cylinder connected to the linkage arms will then move the operable jaw towards the fixed jaw thereby evenly compressing the automobile placed therebetween. The jaws of the present invention are sized so that each compressing action thereof will crush approximately one-third of the length of an average automobile; thus, it will be understood that three or four successive operations of the jaws along the length of the car will be required to completely compress it.

It can be appreciated that if pressure is maintained on the car body or on the scrap the jaws, by virtue of their attachment to the boom of the excavator, can be used to pickup such material and place it where desired. In particular, the present invention can be used to stack the crushed automobile bodies in a pile or place them onto the flatbed of a truck or rail car. In addition, the hydraulic cylinder connected to the securing member provides for more flexible and subtle adjustment of the jaws than would be provided for by the hydraulic system of the boom alone.

A major advantage of the present invention concerns its quick releasable attachment to the boom structure and hydraulic system of a backhoe or similar device. Thus, the present invention is mobile and can be quickly and easily moved to various positions in a scrap yard as needed. In addition, there exist various other scrap handling implements that are designed for such attachment to a backhoe. See, for example, U.S. Pat. No. 3,802,731 issued Apr. 9, 1974, U.S. Pat. No. 4,017,114 issued Apr. 12, 1977, U.S. Pat. No. 4,104,792 issued Aug. 8, 1978, and U.S. Pat. No. 4,519,135 issued May 28, 1985. Thus, as the present invention is interchangeable with various other scrap handling attachments, it can be more cost effectively owned and operated.

It is also a major advantage of the present invention that it can accomplish the task of compressing scrapped automobile bodies, at far less cost than prior art stationary presses.

DETAILED DESCRIPTION OF THE PREFERRED EMBODIMENT OF THE PRESENT INVENTION

Figure 1:
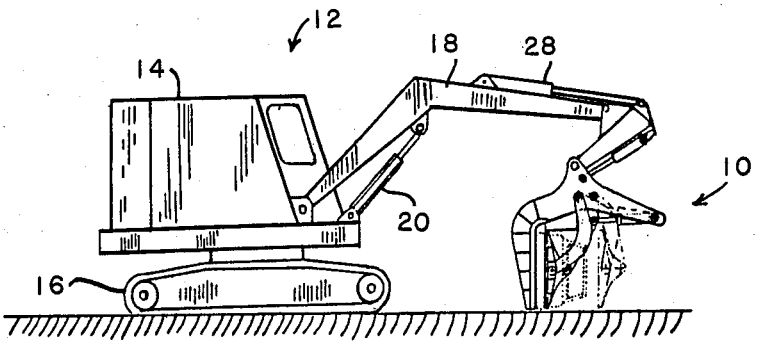
FIG. 1 is an elevation view of the present invention attached to the boom structure and hydraulic system of a backhoe.

One form of the invention is illustrated in the drawings and is described herein. The crushing apparatus is indicated in generally by numeral 10, and is used in connection with a hydraulic excavator or backhoe 12 having a swinghouse 14 which revolves under its own power about a vertical axis relative to a supporting track 16. A boom 18 is mounted on the swinghouse 14, and the vertical position of crusher 10 is controlled by a hydraulic cylinder 20.

Figure 2:
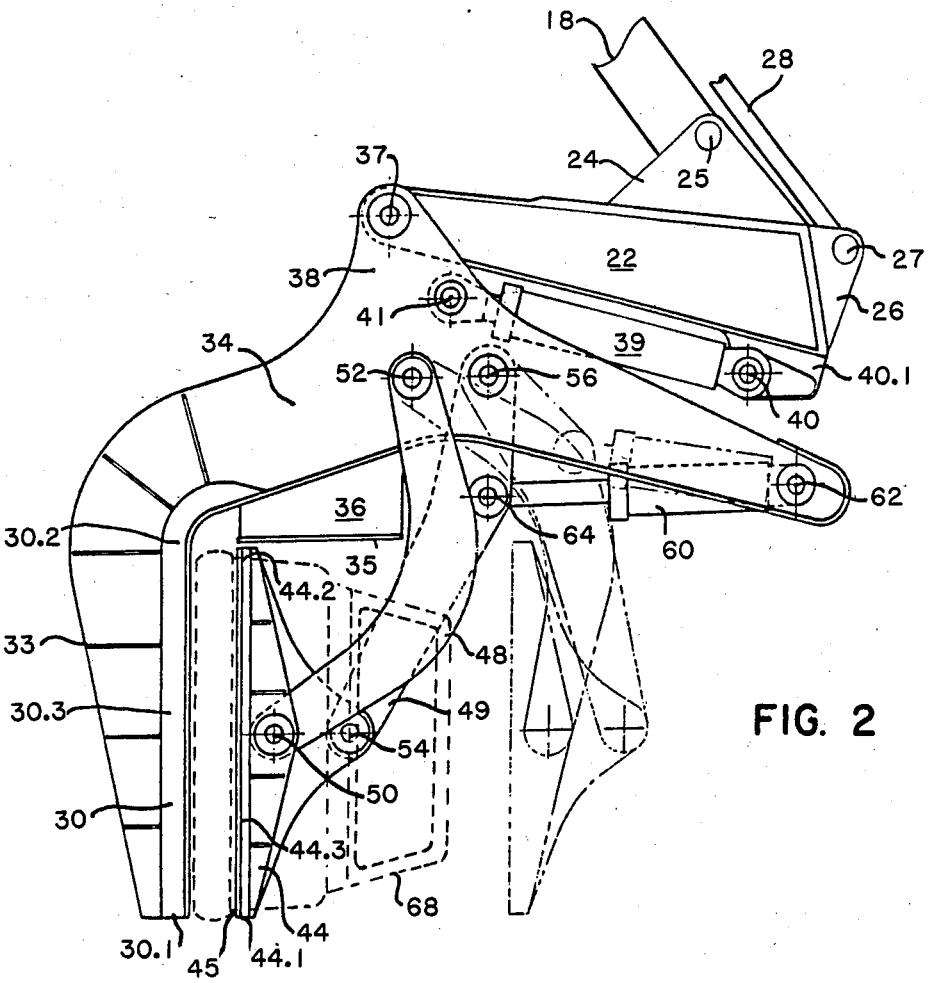
FIG. 2 is an enlarged side elevation view of the present invention.

As seen in FIG. 2, Crusher 10 is secured to boom 18 by an adjustable securing member 22. Securing member 22 includes rigid triangular mounting ears 24 having apertures to receives a mounting pin 25 for releasable securing of boom 18 to crusher 10. Securing member 22 also includes rigid triangular mounting ears 26 having apertures to receives a mounting pin 27 for releasable connection to a hydraulic cylinder 28.

Figure 3:
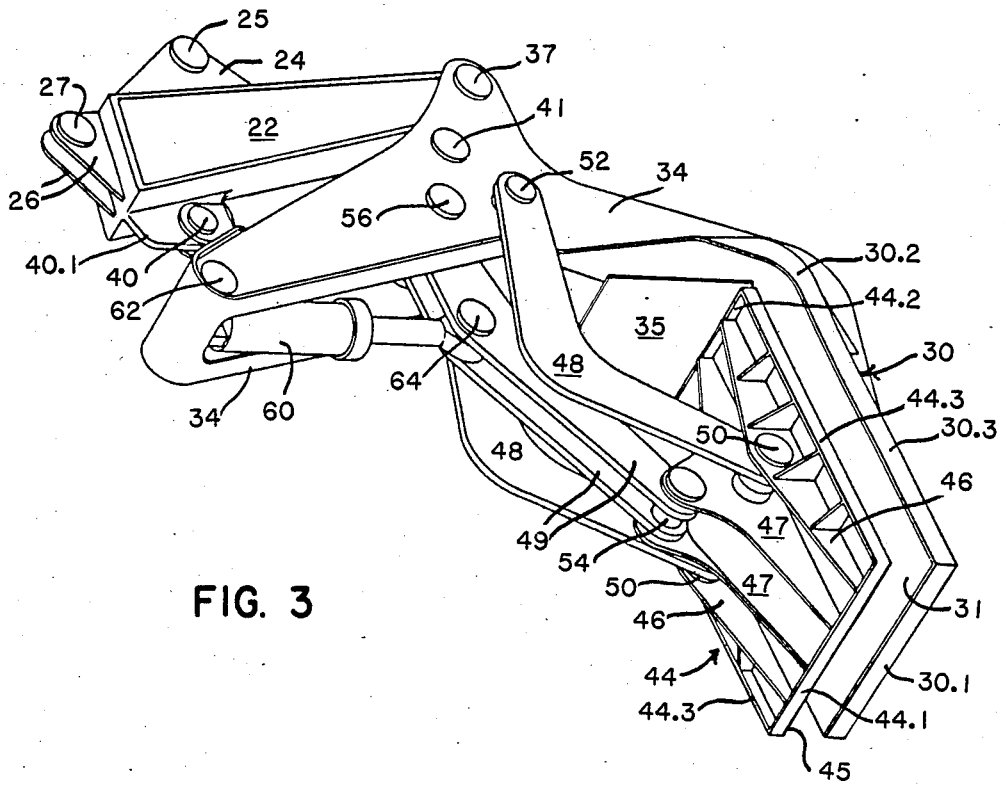
FIG. 3 is an enlarged bottom perspective view of the present invention.

As seen in FIGS. 2 and 3, crusher 10 includes a panel shaped fixed jaw 30 having a bearing surface 31 that is essentially rectangular in shape, having a bottom or distal end 30.1, a top or proximal end 30.2 and side ends 30.3. Jaw 30 is secured on one side to a structural support member 33; and support member 33 is integral with frame members 34. Frame members 34 of jaw 30 are identical in structure and lie adjacent and parallel to each other and extend at an oblique angle from bearing surface 31. A rectangular stop plate 35 is affixed to both frame members 34 by a support 36. Plate 35 lies in a plane that is substantially perpendicular to the plane defined by bearing surface 31.

Adjustable securing member 22 is connected to frame members 34 by a pivot pin 37. Pivot pin 37 extends between and is secured to apertures located at the apex of rigid triangular mounting ears 38 extending from frame members 34 and integral therewith. Securing member 22 also includes a hydraulic cylinder 39. Cylinder 39 is secured on one end to a pivot pin 40 extending through a rigid mounting ear 40.1 extending from and integral with securing member 22, and on its other end to a pivot pin 41 extending between apertures in mounting ears 38.

Crusher 10 also includes an operable jaw 44. Jaw 44 is rectangular in shape having a bottom or distal end 44.1, a top or proximal end 44.2, side ends 44.3, and includes a bearing surface 45 confronting bearing surface 31 of jaw 30. Jaw 44 also includes a pair of outer structural supports 46 and a pair of inner structural supports 47. Supports 46 and 47 extend parallel to each other across jaw 44 from bottom jaw end 44.1 to top jaw end 44.2.

Operable jaw 44 is connected to frame members 34 by a pair of links 48 and a further pair of links 49. Links 48 are arcuate in shape and each are attached on one end to one of the outer structural supports 46, at equivalent positions thereon, by pivot pins 50 extending between and secured to outer supports 46 and each adjacent inner support 47, and on their other ends to equivalent positions on the exterior surface of the middle portion frame members 34 by pivot pins 52. Links 49 lie adjacent to each other and are slightly arcuate in shape, and each are attached on one end to a common pivot pin 54 extending between and secured on each end to inner structural supports 47. The ends of links 49 opposite pivot pin 54 extend between frame members 34 and are connected to a common pivot pin 56 extending between frame member 34, at points thereon adjacent to pivot pin 52.

A hydraulic cylinder 60 is connected on one end to a pivot pin 62 extending between apertures in, and securing the ends of, frame members 34 opposite structural support 33, and on its other end is connected to links 49 by a common pivot pin 64 extending therebetween and secured thereto, at a point along links 49 between pivot pin connections 54 and 56.

The operation of jaw 44 can be appreciated wherein retraction of hydraulic cylinder 60 moves jaw 44 into its fully open position, as represented by the dashed outline thereof seen in FIG. 2. In addition, it can be seen in this fully opened position that the curvature of links 48 and 49 helps to maximize the retraction of jaw 44 and thus, the amount of separation of jaws 30 and 44. Extension of cylinder 60 then causes car 68 to be compressed between surfaces 31 and 45 of jaws 30 and 44. It can be seen that adjustment member 22 provides for attachment of frame members 34 and jaws 30 and 44 to boom 18 so that jaws 30 and 44 can be held and operated in a vertical position. As a result, the space between the jaws is unobstructed along the bottom ends 30.1 and 44.1 thereof, and along the sides 30.3 and 44.3 thereof. Thus, the jaws can be easily lowered onto either side of the wrecked automobile.

As will be appreciated by those skilled in the art, links 48 and 49 form a linkage whereby, the planes defined by bearing surfaces 31 and 45 maintain their parallel orientation as jaw 44 is opened and closed relative to jaw 30. In addition, links 48, by connection to opposite sides of jaw 44, serve to stabilize jaw 44 and keep its bearing surface parallel to that of jaw 30 during compression of the car body, thus, facilitating the compression of the automobile in an even manner. As the width of jaw ends 30.1 and 44.1 is approximately six feet, repeated crushing operations are needed to fully compress the wrecked automobile along its entire length. These repeated crushing operations are facilitated by the fact that the jaws can be held in a vertical orientation and that the space between the jaws is unobstructed along the sides 30.3 and 40.3 thereof.

Plate 35 serves to prevent portions of the car or other scrap material from extending beyond top end 44.2 of jaw 44 so that the particular scrap will be fully compressed by jaw 44, and so the scrap is prevented from possibly becoming entangled in the various pivot and linkage machanism of the present invention.

Crusher 10 can be rotated about the axis of pivot pin 25 by suitable operation of hydraulic cylinder 28, and jaws 30 and 44 can be positioned about the axis of pivot 37 pin by suitable operation of cylinder 39. Cylinder 28 enables a skilled operator to orient jaws 30 and 44 over a range of positions from a vertical to a horizontal orientation relative to the ground. The present invention thus has the flexibility to grasp and compress scrap material lying in a variety of random positions. Furthermore, by maintaining the extension of hydraulic cylinder 60 and thus maintaing pressure on the automobile body or other scrap material, crusher 10 can be used to pick up the scrap and place it where desired, such as on the bed of a truck or rail car. Cylinder 39 can, as with cylinder 28, be used to position jaws 30 and 44 through a variety of positions from vertical to horizontal. However, cylinder 34 is designed to provide for more accurate adjustment thereof, as opposed to the more gross movement provided for by cylinder 28. Also, it can be appreciated that by suitable manipulation crusher 10 itself can be used to perform the step of placing the automobile body onto its side.

It can be understood by those skilled in the art that cylinder 60 is attached at a point along links 49 adjacent pivot 56, and links 48 and 49 are sized with respect to jaws 30 and 44 so that the amount of movement of jaw 44 is proportionally greater than the amount of extension of cylinder 60. Thus, the overall length of crusher 10, and in particular frame members 34, can be minimized.

Although the foregoing description has been concerned with the attachment of crusher 10 to the boom of a hydraulic excavator, or the like, it can be appreciated by those skilled in the art that crusher 10 can equally well be secured to a front-end loader-type machine and operated in conjunction therewith. In this configuration, crusher 10 would take the place of the front end loading bucket and, for example, be suspended from and between the bucket support arms at the ends thereof. As a result thereof, crusher 10 could then be articulated about the ends of the support arms, and also be raised and lowered thereby.

What is claimed is:

1. A crusher assembly for compressing automobile bodies and the like for attachment to the boom structure and hydraulic system of a mobile power source and the like, comprising:

a. a rigid elongate frame having a first end portion, b. securing means for attachment of the frame to the boom structure and hydraulic system of the mobile power source, c. a panel shaped fixed jaw having an exterior confronting surface, the fixed jaw having a proximal end secured to the first end portion of the frame and extending therefrom to a distal end of the fixed jaw, and the fixed jaw having side ends between its distal and proximal ends, d. a panel shaped operable jaw having an exterior confronting surface, the operable jaw having a proximal end adjacent to the frame and extending therefrom to a distal end of the operable jaw, the operable jaw also having side ends between the proximal end and distal end, and including swingable mounting means pivotally connecting the operable jaw to the frame so that the operable jaw is mounted thereon and so that the confronting surface of the movable jaw faces the confronting surface of the fixed jaw, the mounting means providing for swinging of the operable jaw toward and away from the fixed jaw to closed and open positions respectively and providing for orienting the exterior confronting surface of the fixed jaw in a substantially parallel relationship with the exterior confronting surface of the operable jaw when the operable jaw is in said closed position, and the operable jaw and fixed jaw when spaced apart defining a jaw opening therebetween, the jaw opening being unobstructed along the distal ends of the jaws and unobstructed along the side ends of the jaws so that the jaws can be progressively moved along the automobile body in a multistep crushing operation, and so that the jaws can confront either side of the automobile body and be variously positioned along the automobile body, and e. drive means for operating the operable jaw.

2. The crusher assembly as defined in claim 1, wherein the mounting means includes a first pair of links each having a pivotal connection on one end to the frame in spaced relation to said first end portion thereof and on their other ends having pivotal connections to the operable jaw, and a second pair of links spaced from said first pair of links and each having pivotal connections on one end to the frame and on the other end to the operable jaw adjacent opposite side ends thereof.

3. The crusher assembly as defined in claim 1, wherein the mounting means includes first and second pairs of swingable links connecting the operable jaw with the frame, said links being arcuate in shape.

4. The crusher assembly as defined in claim 2, wherein the drive means is a driving hydraulic cylinder, the driving hydraulic cylinder pivotally secured on one end to the frame, and the other end of the driving hydraulic cylinder pivotally secured to the first pair of links at a point therealong intermediate the pivotal connections of the first links to the frame and to the operable jaw.

5. The crusher assembly as defined in claim 4, wherein said point is substantially closer to the pivotal connection to the frame than to the pivotal connection to the operable jaw.

6. The crusher assembly as defined in claim 1, wherein the securing means is an elongate adjustable rigid securing member pivotally secured on one end to the boom structure and hydraulic system of the mobile power source and on its other end pivotally secured to the frame.

7. The crusher assembly as defined in claim 6, wherein the adjustable securing member further includes a hydraulic cylinder, one end of the hydraulic cylinder being pivotally attached to the securing member and the other end of the hydraulic cylinder pivotally attached to the frame.

8. The crusher assembly as defined in claim 1, which further comprises a stop plate secured to the frame adjacent the jaw opening and extending therefrom towards the operable jaw.

9. A crusher assembly for compressing automobile bodies and the like for attachment to the boom structure and hydraulic system of a mobile power source and the like, comprising:

a. a rigid elongate frame having a first end portion, b. securing means for attachment of the frame to the boom structure and hydraulic system of the mobile power source, c. a panel shaped fixed jaw having an exterior confronting surface, the fixed jaw having a proximal end affixed to the first end portion of the frame and extending therefrom, the fixed jaw also having a distal end remote from the frame, and the fixed jaw having side ends between its distal and proximal ends, d. a panel shaped operable jaw, having an exterior confronting surface, the operable jaw having a proximal end adjacent to the frame and extending therefrom the a distal end of the operable jaw, the operable jaw also having side ends between the proximal end and distal end, and including linkage means pivotally connecting the operable jaw to the frame so that the operable jaw is suspended therefrom and so that the confronting surface of the movable jaw faces the confronting surface of the fixed jaw, the linkage providing for swinging of the operable jaw toward and away from the fixed jaw and providing for maintaining the exterior confronting surface of the fixed jaw in a substantially parallel relationship with the exterior confronting surface of the operable jaw during movement of the operable jaw, and e. drive means connected to the linkage means for operating the operable jaw.

10. The crusher assembly as defined in claim 9, wherein the frame includes a second portion spaced from said first end portion, the linkage means includes a first pair of links and a second pair of links spaced from said first pair of links, each of said links being pivotally secured on one end to the frame at the second portion thereof and pivotally secured on their other ends to the operable jaw, and said first and second pairs of links being spaced from each other and being variously spaced from said side ends of the operable jaw.

11. The crusher assembly as defined in claim 10, wherein, the first and second pair of links are arcuate in shape.

12. The crusher assembly as defined in claim 10, wherein the frame also includes a third portion spaced from said first end portion, the drive means includes a driving hydraulic cylinder, the driving hydraulic cylinder being pivotally secured on one end to the third portion of the frame, and the other end of the driving hydraulic cylinder being pivotally secured to the first links at the point intermediate the ends thereof.

13. The crusher assembly as defined in claim 12, wherein the driving hydraulic cylinder is connected to a point along the first pair of links adjacent their point of pivotal securement to the frame.

14. The crusher assembly as defined in claim 9, wherein the securing means is a rigid securing member pivotally secured on one end to the boom structure and hydraulic system of the mobile power source and on its other end pivotally secured to the frame.

15. The crush erassembly as defined in claim 14, wherein the rigid securing member further includes a hydraulic cylinder, one end of the hydraulic cylinder being pivotally attached to the securing member and the other end of the hydraulic cylinder pivotally attached to the frame.

16. The crusher assembly as defined in claim 9, which further comprises a stop plate secured to the frame member and extending therefrom towards the operable jaw.

17. A crusher assembly for compressing automobile bodies and the like for releasable attachment to the boom structure and hydraulic system of a mobile power source and the like, comprising:

a. a rigid elongate frame, having a first end, a second end and a middle portion therebetween, b. an adjustable securing member pivotally secured on one end to the boom structure and hydraulic system of the mobile power source and on its other end pivotally secured to the middle portion of the frame, c. a panel shaped fixed jaw, having an exterior confronting surface, the fixed jaw having a top end secured to and integral with the first end of the frame and depending therefrom to a bottom end of the fixed jaw, and the fixed jaw having side ends between its bottom and top ends, d. a panel shaped operable jaw, having an exterior confronting surface, the operable jaw having a top end adjacent to the frame and depending downwardly therefrom to a bottom end of the operable jaw and the operable jaw having side ends between the top end and bottom end, and the operable jaw connected to the frame by a linkage means, the linkage means including a first pair of links pivotally secured on one end to the frame at the middle portion thereof and on their other ends pivotally secured to a central portion of the operable jaw, and a second pair of links each pivotally secured on one end to opposite sides of the operable jaw at equivalent positions thereon and the opposite ends of the second pair of links each pivotally secured to equivalent positions on the exterior surface of the middle portion of the frame so that the operable jaw is suspended therefrom and so that the confronting surface of the movable jaw is facing the confronting surface of the fixed jaw, the linkage means providing for swinging of the operable jaw towards and away from the fixed jaw and providing for maintaining the exterior confronting surface of the fixed jaw in a substantially parallel relationship with the exterior confronting surface of the operable jaw, during movement of the operable jaw, and the operable jaw and fixed jaw when spaced apart defining an opening therebetween the opening being unobstructed along the bottom ends of the jaws opposite the frame and unobstructed along the sides of the jaws between the bottom ends thereof and the frame so that the jaws can be lowered to confront either side of the automobile body and so that the jaws can be positioned along the automobile body, and e. a driving hydraulic cylinder pivotally secured on one end to the second end of the frame and the other end of the driving hydraulic cylinder pivotally secured to the first links at a point therealong adjacent the point of connection of the first links to the frame and the first and second pair of links sized with respect to the fixed jaw and operable jaw so that the amount of movement of the operable jaw is maximized with respect to the amount of extension of the driving hydraulic cylinder.

18. The crusher assembly as defined in claim 17, wherein, the adjustable securing member further includes, a hydraulic cylinder, one end of the securing member hydraulic cylinder pivotally attached to the securing member and the other end of the securing member hydraulic cylinder pivotally attached to the middle portion of the frame.

19. The crusher assembly as defined in claim 17, which further comprises a stop plate secured to the frame and extending therefrom towards the operable jaw.

* * * * *

UNITED STATES PATENT AND TRADEMARK OFFICE

CERTIFICATE OF CORRECTION

PATENT NO. : 4,697,509

DATED : October 6, 1987

INVENTOR(S) : Roy E. LaBounty

It is certified that error appears in the above-identified patent and that said Letters Patent is hereby corrected as shown below:

Column 1, line 37, delete --dealer-- and insert "dealers".

Column 3, line 28, delete --receives-- and insert "receive".

In claim 9(d) - column 7, line 2, delete --the--, first occurrence, and insert -- to --.

In claim 15, column 7, line 48, delete --crush erassembly-- and insert "crusher assembly".

Signed and Sealed this

Seventh Day of June, 1988

*Attest:*

*Attesting Officer*

DONALD J. QUIGG

*Commissioner of Patents and Trademarks*